350-276 SR

11/25/80 OR 4,235,523

United States Patent [19]

Lapeyre

[11] 4,235,523

[45] * Nov. 25, 1980

[54] CONTROLLED REFLECTION READOUT FOR DISPLAYS

[75] Inventor: James M. Lapeyre, New Orleans, La.

[73] Assignee: Digicourse Inc., New Orleans, La.

[ * ] Notice: The portion of the term of this patent subsequent to Jun. 28, 1994, has been disclaimed.

[21] Appl. No.: 14,584

[22] Filed: Feb. 23, 1979

Related U.S. Application Data

[63] Continuation of Ser. No. 774,508, Mar. 8, 1977, abandoned, which is a continuation-in-part of Ser. No. 670,965, Mar. 26, 1976, Pat. No. 4,032,222.

[51] Int. Cl.[3] ..... G02B 27/00

[52] U.S. Cl. ..... 350/276 R; 340/84

[58] Field of Search ..... 358/199, 250; 250/549; 340/84; 350/97-105, 276, 110, 276 SL, 549; D 10/115

[56] References Cited

U.S. PATENT DOCUMENTS

| | | | |
|---|---|---|---|
| 2,162,791 | 6/1939 | Shreve | 350/276 SL |
| 3,499,112 | 3/1970 | Heilmeir et al. | 178/7.7 |
| 3,986,014 | 10/1976 | Katsui et al. | 350/276 |
| 4,032,222 | 6/1977 | Lapeyre | 350/276 R |

FOREIGN PATENT DOCUMENTS

| | | | |
|---|---|---|---|
| 930848 | 7/1963 | United Kingdom | 40/7 |

*Primary Examiner*—John K. Corbin
*Assistant Examiner*—B. W. de los Reyes
*Attorney, Agent, or Firm*—Wilkinson, Mawhinney & Theibault

[57] ABSTRACT

The present disclosure is directed to a controlled reflection readout for information displays or targets such as digital or instrumentation panels for such apparatus as computers, compasses, watches, clocks and consoles wherein the display is not placed normal to the viewing plane and cannot be read at 90° to the display. The display or specular transparent window is inclined to the line of sight and glare shielding means which extends forwardly from the top of the display or target to prohibit reading the display at a right angle thereto whereby reflections from the sun or lights in a room will interfere with reading through the optically transparent window in front of the target or display.

3 Claims, 13 Drawing Figures

CONTROLLED REFLECTION READOUT FOR DISPLAYS

This is a continuation of application Ser. No. 774,508 filed Mar. 8, 1977, now abandoned, which was a continuation-in-part of Ser. No. 670,965, filed Mar. 26, 1976 now U.S. Pat. No. 4,032,222.

An object of the present invention is the elimination of reflection on the front surface of an optically transparent window in front of a display particularly in the application of digital display readouts employed on ships, aircraft where reflections are ever present from the sun and water.

A further object is to eliminate ambient light reflections otherwise visible when viewing information displays.

A further object of the present invention is the provision of a casement mounting encompassing light emitting or non-light emitting targets to eliminate ambient light reflection interference.

A still further object of the present invention is the interposing of a shielding means having a non-reflective light absorbing surface to restrict the viewing angle to thereby accentuate the visibility of the target presentations.

A still further object of the present invention is to eliminate the ambiguity of certain signalling displays that sometimes appear to be on, even when they are off, due to the reflection of high ambient light sources. All experienced automobile drivers have experienced difficulty in determining whether a traffic signal is on or off when direct sunlight is being reflected off the signal.

With the foregoing and other objects in view the invention will be more fully described hereinafter and more particularly pointed out in the appended claims.

In the drawings in which like parts are denoted by reference characters throughout the several views.

Figure 2:
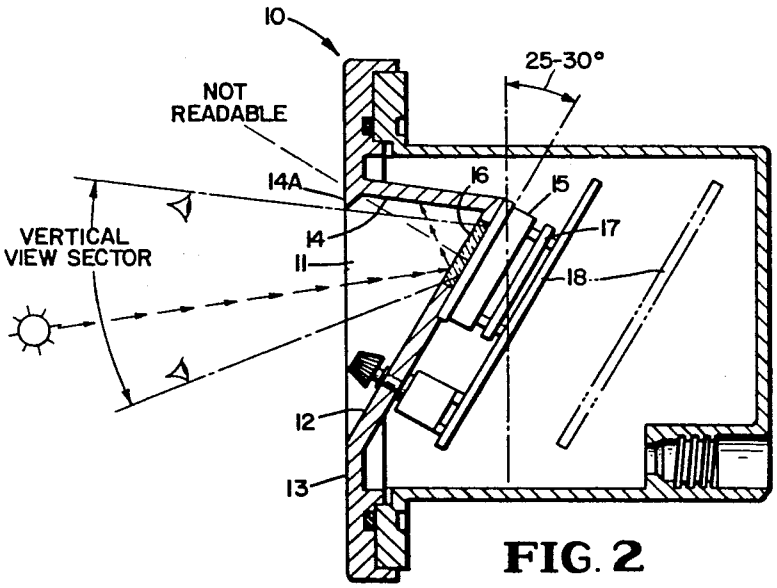
FIG. 2 is a vertical section of the casement of FIG. 1 taken on the lines 2—2 in FIG. 1.

Referring now to the drawings, 10 designates a casement having an angular depression 11 in its front or readout face 12. The readout face 12 is at an angle of the order of 25° to 80° relative to the front plane of the front cover 13 of the casement 10. The upper surface 14 of the depression defines a blocking shield to prohibit reading the digital display 15 directly on or at an angle of 90° thereto. A drip lip 14A is provided to keep rain or water spray from entering the casement depression and fouling the optically specular transparent window 16 which is parallel to and in front of the digital display. The digital display 15 has a connector 17 and printed circuit board 17 for controlling the digital presentation.

One of the preferred forms of the invention finds application aboard sail boats or power boats where the helmsman steers the boat from the readings presented by the digital display and it is important to eliminate reflections from the sun and water to accentuate the visibility of the lights in the digital display and render them sharp and vivid.

Ideally the entire front cover 13 has a non-reflective surface.

Figure 4:
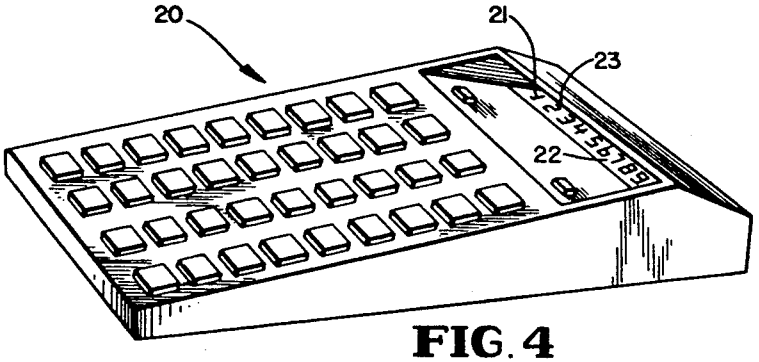
FIG. 4 is a vertical section of the light emitting digital display portion of the computer of FIG. 3, taken at an enlarged scale.
Figure 1:
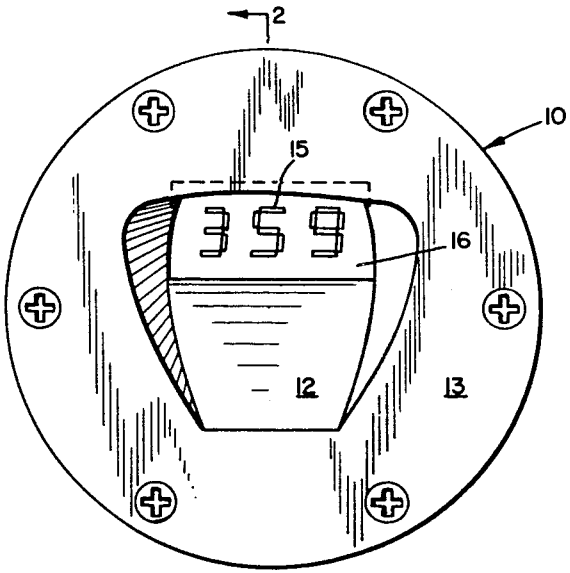
FIG. 1 is a front elevational view of a controlled reflection readout casement having a light emitting digital display mounted for viewing therein.
Figure 3:
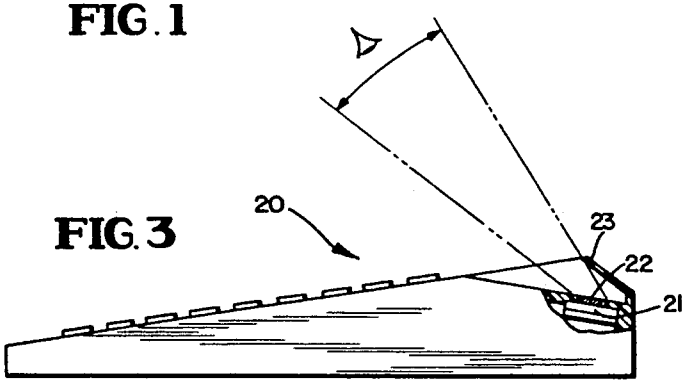
FIG. 3 is a perspective view of a pocket computer having the controlled reflection readout of the present invention about its light emitting digital display.

Referring now to FIGS. 3 and 4, 20 designates a portable calculator having a digital readout 21 viewable through an optically transparent window 22. Forwardly of and above the window 22 is a shield 23 which cooperates with the angular positioning of the digital display and its parallel optically transparent window to render the digital readout incapable of being read straight on or with the line of vision at a right angle to the window 22 to thereby eliminate reflections of external objects from the surface of window 22. The angular positioning of the window 22 and digital display is the same 25° to 80° as shown in FIG. 2.

Figure 6:
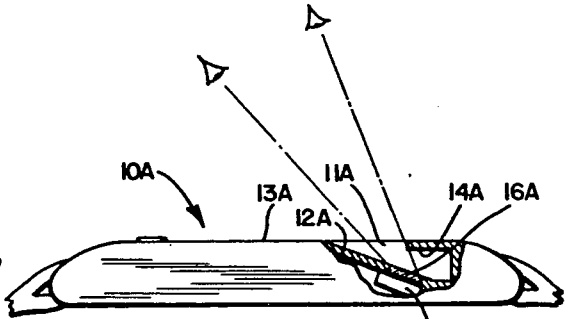
FIG. 6 is a side elevational view of the watch casement of FIG. 5 with parts broken away and parts shown in section.
Figure 5:
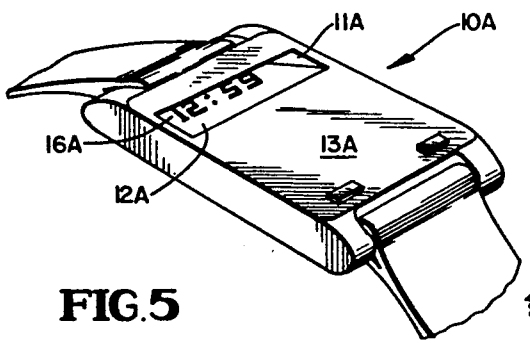
FIG. 5 is a perspective view of a digital wrist watch casement constructed in accordance with the present invention.

Referring now to FIGS. 5 and 6, 10A designates a watch casement an angular depression 11A in its front or readout face 12A. The readout face is at an angle of the order of 25° to 80° relative to the front plane of the front cover 13A of the casement 10A. The upper surface 14A of the depression defines a blocking shield to prohibit reading the light emitting digital display 15A directly or on an angle of 90° thereto. An optically transparent window 16A is parallel to and in front of the light emitting digital display 15A. The blocking shield 14A has a non-reflective surface.

Figure 8:
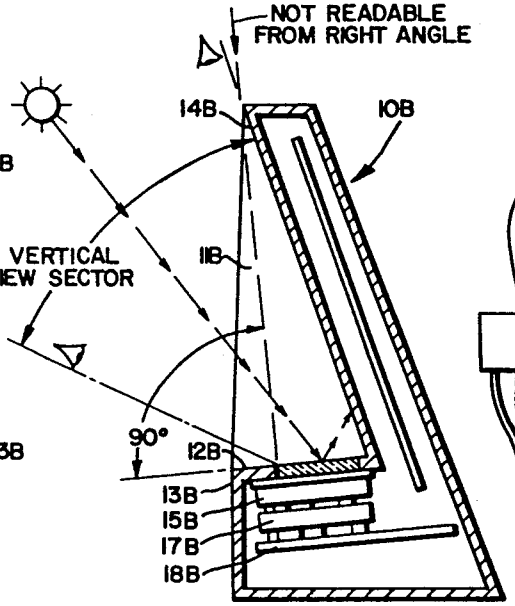
FIG. 8 is a vertical sectional view taken on the line 8—8 in FIG. 7.
Figure 7:
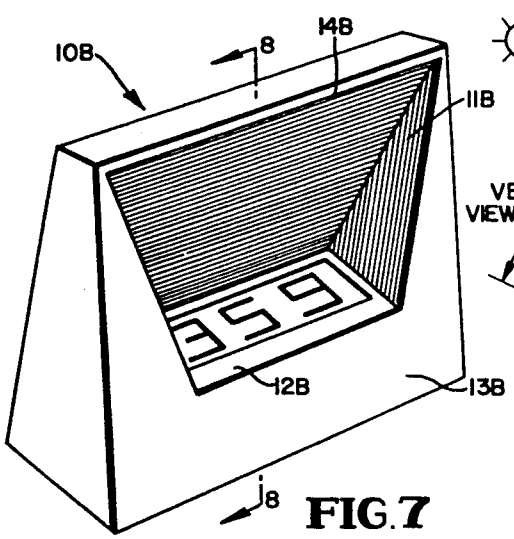
FIG. 7 is a perspective view of a digital clock constructed in accordance with the present invention.

Referring now to FIGS. 7 and 8, 10B designates a clock casement having an angular depression 11B in its front readout face 12B at an angle relative to the front plane of the front cover 13B of the casement 10B. The upper surface 14B of the depression defines a blocking shield to prohibit looking into the specular glass surface 16 or reading the light emitting digital display 15B directly on or at an angle of 90° thereto. The digital display 15B has a connector 17B and printed circuit board 18B for controlling the digital presentation and is positioned at an angle of the order of 25° to 80° relative to the front plane 13B of the casement.

Figure 9:
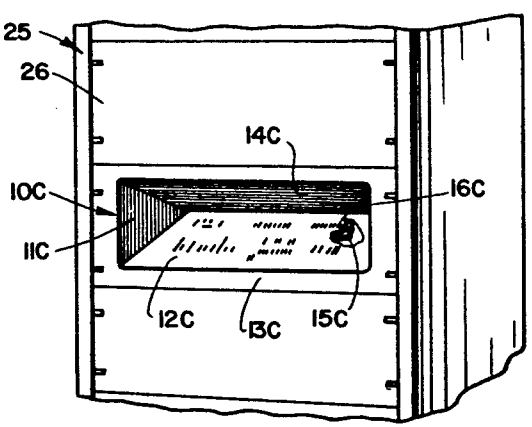
FIG. 9 is a front perspective view of the light emitting controlled reflection readout display of the present invention as applied to instrument rack assembly of readouts.

Referring now to FIG. 9, 25 designates a rack of instruments 26 having casements 10C having an angular depression 11C in their front or readout faces 12C. The readout face is at an angle of the order of 25° to 80° relative to the front plane of the front cover 13C of the casement 10C. The upper surface 14C of the depression defines a blocking shield to prohibit reading the light emitting digital or alphanumeric target 15C directly or on an angle of 90° thereto. An optically transparent window 16C is parallel to and in front of the light emitting display or target 15C. The block shield 14C has a non-reflective surface.

Figure 10:
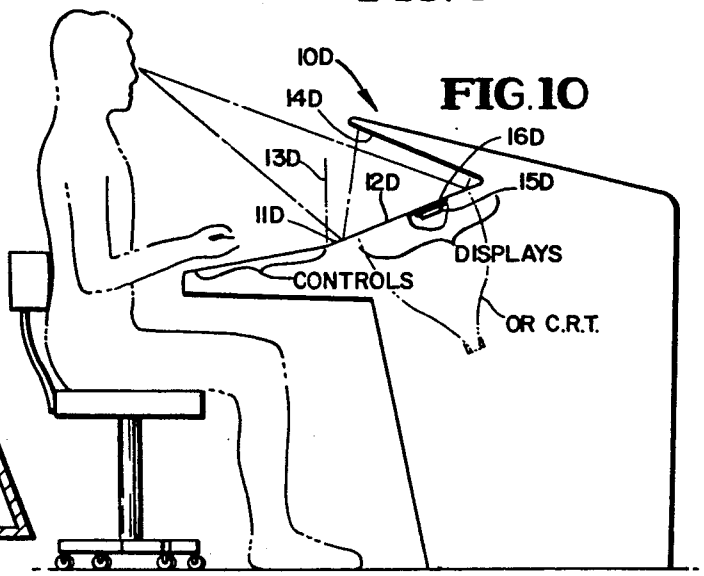
FIG. 10 is a side elevational view of a console and observer viewing the light emitting information readout of the present invention.

Referring now to FIG. 10, 10D designates a console casement having an angular depression 11D in the front of the console 12D. The readout face 12D is at an angle of the order of 25° to 80° relative to the front plane of the front cover 13D of the console 10D. The upper surface 14D of the depression defines a blocking shield to prohibit reading the light emitting information display 15D directly or on an angle of 90° thereto. An optically specular transparent window 16D is parallel to and in front of the light emitting display 15D. The blocking shield 14D has a non-reflective surface.

The light emitting display may be of the gaseous discharge tube type or the light emitting diode type.

Figure 11:
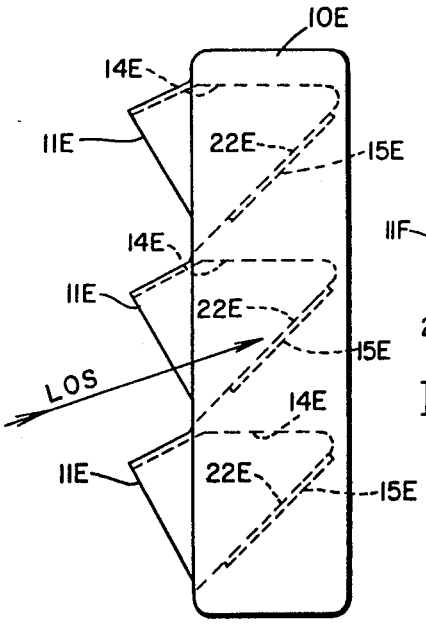
FIG. 11 is a side elevational view of a traffic signal constructed in accordance with the present invention.

Referring now to the specie of the invention shown in FIG. 11, a traffic light signal casement 10E is shown having front viewing openings 11E providing for viewing a window or specular transparent surface 22E positioned at an angle of the order of 25° to 80°, specifically in this embodiment 40° relative to the front plane of the casement 10E along a line of sight designated LOS. A light or lamp 15E is behind the window. Ambient light reflections are directed from the window 22E onto the surface 14E and are not reflected back into the eyes of the viewer because the surface 14E has a non-reflective surface and the angle of the specular surface 33E is such that ambient light does not return along the LOS.

Figure 13:
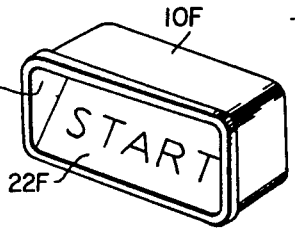
FIG. 13 is a perspective view of the casement of FIG. 12.
Figure 12:
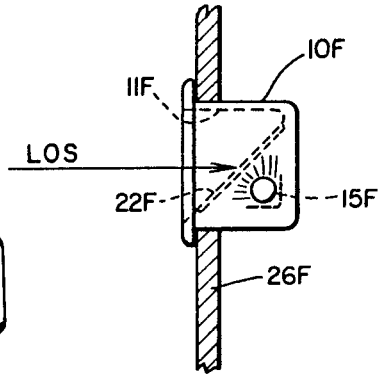
FIG. 12 is a side elevational view of a motor starter panel indicating light casement constructed in accordance with the present invention.

Referring now to FIGS. 12 and 13, an operating panel 25F having a casement 10F having an opening and angular depression 11F leading to an angularly disposed window or specular surface 22F, behind which is an indicating lamp 15F. The window 22F is at an angle of the order of 25° to 80° relative to the vertical plane of the front opening and as shown in FIG. 12 is 45°.

Referring now to the species shown in FIG. 14, 15, a television receiver cabinet or casement 10G is shown having an angular depression 11G in which is disposed a cathode ray tube 15F, the front surface of which is inclined at an angle of the order of 25°to 80°, the embodiment of FIG. 14 being 45° from the front vertical plane of the casement 10G. The surface 22G absorbs the reflected ambient light rays from the specular glass surface 22E of the cathode ray tube. The angular disposal prevents ambient light from being reflected back along the line of sight (LOS) into the eyes of the viewer.

Referring now to FIGS. 16 and 17, a target 15H or light emitting display is positioned behind a window 16H which is a transparent specular member which may be either parallel to the display 15H as shown for example in FIGS. 2 and 3 or may be inclined at an angle of the order of 25° to 80° from the plane of the display for instance as shown in FIG. 18. An interposer 22H prohibits the window 16H from being viewed at 90° to its surface within a vertical view sector, since at that angle specular reflection of ambient light back to the viewer would be possible.

The important feature is that the specular window glass surface 16H is interposed at such an angle in the line of sight from the viewing sector to the display target 15H that specular reflection of ambient light is directed away from the line of sight and thus does not interfere with the view r's signting of the display target 15H, which could be an instrument dial or needle inside a casing with a viewing window glass 16H on the surface thereof, for example.

As shown in FIG. 16, the specular transparent window 16H need not be parallel to the target display 15H, and the target viewing sector is limited to lie between the front top of the interposer 22H and the bottom edge of window 16H while subtending the target display 15H. The reflected ambient light rays are preferably absorbed by an optically black surface 22G on the underside of the interposer 22H.

The embodiment of the invention shown in FIG. 18 shows a square or rectangular casement 10J having an interposer 22J to prohibit the specular surface 16H from being viewed at 90° to its surface. Thus the specular transparent surface 16J reflects the ambient light rays away from the line of sight into the interposer 22J to keep ambient rays from being reflected back into the eyes of the viewer, so that there is no interference or dilution of the view of target display 15J.

What I claim is:

1. A traffic signal indicator having a glare and reflection control for ambient light comprising:

(a) a casement housing containing said indicator having a view opening therein to permit viewing of the indicator inside said casement along a viewing light of sight, (b) a traffic signal indicator device presenting a visual display positioned in said casement along said viewing line of sight, (c) an interposer surface positioned on said casement in a direction substantially parallel to said line of sight thereby to exclude the interposer surface from the field of view of said visual display, so that the field viewing angle is restricted to less than 90° relative to the front plane of said casement, (d) a transparent specular surface disposed at a depth within the casement in the field of view to the visual display and disposed at an angle of the order of 25° to 80° relative to the front plane of said casement directing the specular surface reflections of ambient light entering the casement from the viewing sector in a direction away from the viewing sector and into the interposer surface, said display being disposed at the same angle as said specular surface, and (e) a lamp positioned behind the visual display along said line of sight to visibly actuate said display.

2. A readout as claimed in claim 1 wherein said visual display is a traffic signal disposed with a substantially horizontal interposer extending as a hood outside said casement along said line of sight.

3. A readout as claimed in claim 1 wherein said casement is an indicator housing for the operational status of traffic control machinery with said interposer extending inside the casement.

* * * * *